US012038225B2

(12) United States Patent
Wang et al.

(10) Patent No.: US 12,038,225 B2
(45) Date of Patent: Jul. 16, 2024

(54) DOOR OF REFRIGERATOR AND ASSEMBLY METHOD THEREOF

(71) Applicants: QINGDAO HAIER REFRIGERATOR CO., LTD., Shandong (CN); HAIER SMART HOME CO., LTD., Shandong (CN)

(72) Inventors: Wenchun Wang, Qingdao (CN); Enpin Xia, Qingdao (CN); Tong Xu, Qingdao (CN); Hao Zhang, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 262 days.

(21) Appl. No.: 17/632,306

(22) PCT Filed: Jul. 29, 2020

(86) PCT No.: PCT/CN2020/105502
§ 371 (c)(1),
(2) Date: Feb. 2, 2022

(87) PCT Pub. No.: WO2021/023077
PCT Pub. Date: Feb. 11, 2021

(65) Prior Publication Data

US 2022/0290910 A1 Sep. 15, 2022

(30) Foreign Application Priority Data

Aug. 2, 2019 (CN) ..... 201910713632.5

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01); *F25D 2323/02* (2013.01); *F25D 2400/18* (2013.01); *F25D 2400/36* (2013.01)

(58) Field of Classification Search
CPC .... F25D 2400/36; F25D 23/028; F25D 23/02; F25D 2400/361; F25D 29/005;
(Continued)

(56) References Cited

U.S. PATENT DOCUMENTS 5,007,226 A * 4/1991 Nelson ..... F25D 23/02 52/784.15
10,345,029 B2 * 7/2019 Ding ..... F25D 23/028
(Continued)

FOREIGN PATENT DOCUMENTS

CN 1742185 A 3/2006
CN 101131288 A 2/2008
(Continued)

OTHER PUBLICATIONS

International Search Report for PCT/CN2020/105502 (ISA/CN) mailed Oct. 28, 2020 (7 pages).
(Continued)

*Primary Examiner* — Hiwot E Tefera
(74) *Attorney, Agent, or Firm* — ALSTON & BIRD LLP

(57) ABSTRACT

A door of a refrigerator, comprising: a panel having a main body, a left side and a right side; a display screen disposed behind the panel and having, corresponding to the structure of the panel, a main body, a left side and a right side; a main control board for controlling the display screen; a bracket disposed behind the display screen to provide support for the display screen; an inner door lining disposed behind the bracket to provide support for the bracket; an outer door lining disposed behind the inner door lining; and a trim strip
(Continued)

group, with a foaming space being confined among the inner door lining, the outer door lining and the trim strip group.

8 Claims, 8 Drawing Sheets

(58) Field of Classification Search
CPC ..... F25D 2400/18; F25D 27/005; F25D 2323/02; F25D 29/00
See application file for complete search history.

(56) References Cited

U.S. PATENT DOCUMENTS

| | | | | |
|---|---|---|---|---|
| 2010/0327720 | A1* | 12/2010 | Pae | F25D 23/028 49/70 |
| 2013/0026900 | A1* | 1/2013 | Oh | E05D 11/0081 312/401 |
| 2016/0341468 | A1* | 11/2016 | Joo | F25D 11/02 |
| 2017/0176091 | A1* | 6/2017 | Becke | F25D 29/005 |
| 2017/0191745 | A1* | 7/2017 | Choi | F25D 23/028 |
| 2017/0191746 | A1* | 7/2017 | Seo | F25D 27/005 |
| 2017/0234609 | A1* | 8/2017 | Park | F25D 29/005 345/174 |
| 2017/0370636 | A1* | 12/2017 | Koo | F25D 23/02 |
| 2018/0160824 | A1* | 6/2018 | Lee | F25D 11/00 |
| 2018/0192791 | A1* | 7/2018 | Miller | F25D 23/02 |
| 2018/0292127 | A1* | 10/2018 | Park | H05B 47/12 |
| 2019/0249485 | A1* | 8/2019 | Jeong | E06B 3/6722 |
| 2021/0140702 | A1* | 5/2021 | Park | F25D 23/028 |
| 2021/0318061 | A1* | 10/2021 | Lee | F25D 23/028 |

FOREIGN PATENT DOCUMENTS

| | | | |
|---|---|---|---|
| CN | 101469933 | A | 7/2009 |
| CN | 204480603 | U | 7/2015 |
| CN | 105571237 | A | 5/2016 |
| CN | 106091552 | A | 11/2016 |
| CN | 106524657 | A | 3/2017 |
| CN | 106610166 | A | 5/2017 |
| CN | 106642946 | A | 5/2017 |
| CN | 106679293 | A | 5/2017 |
| CN | 206257870 | U | 6/2017 |
| CN | 206787156 | U | 12/2017 |
| CN | 107782061 | A | 3/2018 |
| CN | 207318893 | U | 5/2018 |
| CN | 108759269 | A | 11/2018 |
| CN | 109297245 | A | 2/2019 |
| CN | 109357472 | A | 2/2019 |
| EP | 3333517 | A1 | 6/2018 |
| EP | 3572748 | A4 | 10/2020 |
| WO | WO 2018/082292 | A1 | 5/2018 |

OTHER PUBLICATIONS

Written Opinion for PCT/CN2020/105502 (ISA/CN) mailed Oct. 28, 2020.
First Search Report and Office Action for China Application No. 2019107136325 dated May 28, 2021 (7 pages).
Search Report for EP Application No. 208498480.7 dated Aug. 3, 2022 (4 pages).
1st Office Action for EP Application No. 20849480.7 dated Aug. 16, 2022 (5 pages).
Notification of Grant for China Patent Application No. 201910713632.5 dated Nov. 17, 2021 (2 pages).

* cited by examiner

DOOR OF REFRIGERATOR AND ASSEMBLY METHOD THEREOF

CROSS-REFERENCE TO RELATED APPLICATIONS

The present application is a national phase entry of International Application No. PCT/CN2020/105502, filed Jul. 29, 2020, which claims priority to Chinese Patent Application 201910713632.5, filed Aug. 2, 2019, which are incorporated herein by reference in their entirety.

FIELD OF THE INVENTION

The present invention relates to the technical field of refrigerating and freezing devices, and in particular to a door of a refrigerator and an assembly method thereof.

BACKGROUND OF THE INVENTION

In the existing glass door of a refrigerator, a display screen can only be attached to flat or curved glass. However, because a border with a glue distance of at least 20 mm needs to be reserved, the display range of the left and right sides of the existing glass door is limited, and large-screen display cannot be achieved, which affects the display effect.

BRIEF DESCRIPTION OF THE INVENTION

An objective of the present invention is to provide a door of a refrigerator that realizes large-screen display.

A further objective of the present invention is to stably assemble a display screen.

Particularly, the present invention provides a door of a refrigerator, including:

a panel having a main body that constitutes a front end of the door, a left side and a right side;

a display screen disposed behind the panel and having, corresponding to the structure of the panel, a main body, a left side and a right side;

a main control board for controlling the display screen;

a bracket disposed behind the display screen to provide support for the display screen;

an inner door lining disposed behind the bracket to provide support for the bracket;

an outer door lining disposed behind the inner door lining to constitute a rear end of the door; and a trim strip group, with a foaming space being confined among the inner door lining, the outer door lining and the trim strip group.

Optionally, the trim strip group includes a left trim strip and a right trim strip;

the left side of the panel constitutes a left end of the door, and its inner side is in contact with an outer surface of the left trim strip; and the right side of the panel constitutes a right end of the door, and its inner side is in contact with an outer surface of the right trim strip.

Optionally, the bracket has a main body, a left side and a right side; the main body of the bracket is disposed corresponding to the main body of the display screen;

the left side of the bracket is disposed corresponding to the left side of the display screen; and the right side of the bracket is disposed corresponding to the right side of the display screen.

Optionally, a board installation area is formed on an inner side of the main body of the bracket for installing the main control board.

Optionally, a plurality of support ribs are formed on the inner side of the main body of the bracket.

Optionally, the support ribs include horizontal support ribs and vertical support ribs, and the horizontal support ribs are provided with a plurality of ventilation openings; and the trim strip group includes an upper trim strip constituting an upper end of the door and a lower trim strip constituting a lower end of the door, the upper trim strip and/or the lower trim strip are(is) provided with a plurality of ventilation holes, and the plurality of ventilation openings and the plurality of ventilation holes realize heat dissipation of the display screen.

Optionally, special-shaped protrusions are formed at intervals on the plurality of vertical support ribs; and gaps are formed between the special-shaped protrusions and the vertical support ribs, and tops of the special-shaped protrusions resist against the inner door lining.

Optionally, the inner door lining has a main body, a left side and a right side, the main body protrudes upward to form a plurality of limiting portions, and the left side and the right side are recessed inward respectively to form recessed structures; wherein the main body of the bracket is located in a space confined by the plurality of limiting portions;

the left side of the bracket is disposed corresponding to the recessed structure of the left side of the inner door lining; and the right side of the bracket is disposed corresponding to the recessed structure of the right side of the inner door lining.

Optionally, the longitudinal section of the recessed structure of the inner door lining is L-shaped, the recessed structure has a bottom surface and a side surface, and the side surface protrudes outward to form at least one auxiliary protrusion; wherein a bottom surface of the left side of the bracket resists against the bottom surface of the recessed structure of the left side of the inner door lining, and an inner surface of the left side of the bracket resists against the auxiliary protrusion of the recessed structure of the left side of the inner door lining; and a bottom surface of the right side of the bracket resists against the bottom surface of the recessed structure of the right side of the inner door lining, and an inner surface of the right side of the bracket resists against the auxiliary protrusion of the recessed structure of the right side of the inner door lining.

The present invention further discloses a method for assembling the aforementioned door of a refrigerator, including the steps of:

assembling the trim strip group, the inner door lining and the outer door lining, and foaming;

assembling the bracket pasted with the display screen to the inner door lining; and gluing the panel with the trim strip group to complete the assembly of the door.

The door of a refrigerator according to the present invention is provided with a panel and a display screen having a main body, a left side and a right side respectively, and the display screen is fixed by the bracket and the inner door lining, so as to achieve a large-screen display effect with no borders or narrow borders on the left and right sides.

Further, the assembly method of the present invention realizes the assembly of the large-screen display door of a refrigerator by assembling the trim strip group, the inner door lining and the outer door lining and foaming, then assembling the bracket pasted with the display screen, and finally gluing the panel.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the drawings, like reference numerals denote like or similar parts or elements. A person skilled in the art should understand that these drawings are not necessarily drawn to scale. In the figures.

DETAILED DESCRIPTION

In the following description, the directions or positional relationships indicated by "upper", "lower", "left", "right", etc. are based on the directions referenced by a refrigerator 100 itself. The "upper", "lower", "left", and "right" are the directions indicated in FIG. 1.

Figure 1:
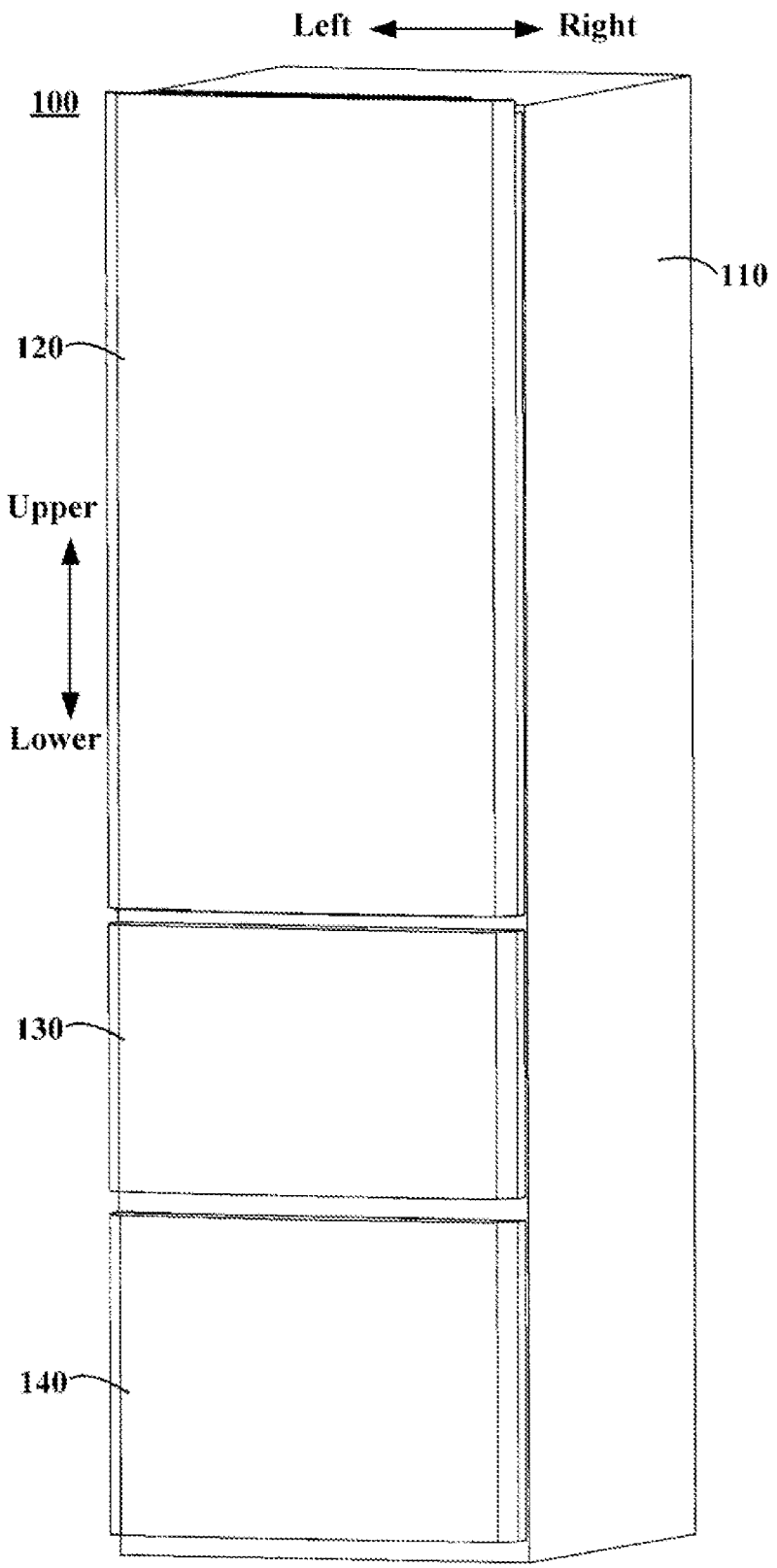
FIG. 1 is a schematic three-dimensional diagram of a refrigerator according to an embodiment of the present invention.

FIG. 1 is a schematic three-dimensional diagram of a refrigerator 100 according to an embodiment of the present invention. Storage compartments are confined inside a cabinet 110 of the refrigerator 100. The number and structure of the storage compartments can be configured according to requirements. For example, FIG. 1 shows a situation where a first storage compartment, a second storage compartment and a third storage compartment are disposed sequentially up and down. The first storage compartment is with a rotary opening door 120 which is disposed on the front surface of the cabinet 110 for closing the storage compartment. The second storage compartment and the third storage compartment are provided with a first drawing storage device 130 and a second drawing storage device 140, which are disposed in the storage compartments in a drawable manner. The storage compartments can be configured as a refrigerating compartment, a freezing compartment, a variable temperature compartment or a fresh-keeping compartment according to different uses. Each storage compartment can be divided into a plurality of storage areas by partitions, and shelves or drawers are used to store items. The refrigerator 100 according to the embodiment of the present invention may be a typical French refrigerator, and the three compartments disposed sequentially up and down are a refrigerating compartment, a freezing compartment, and a freezing compartment, respectively.

Figure 2:
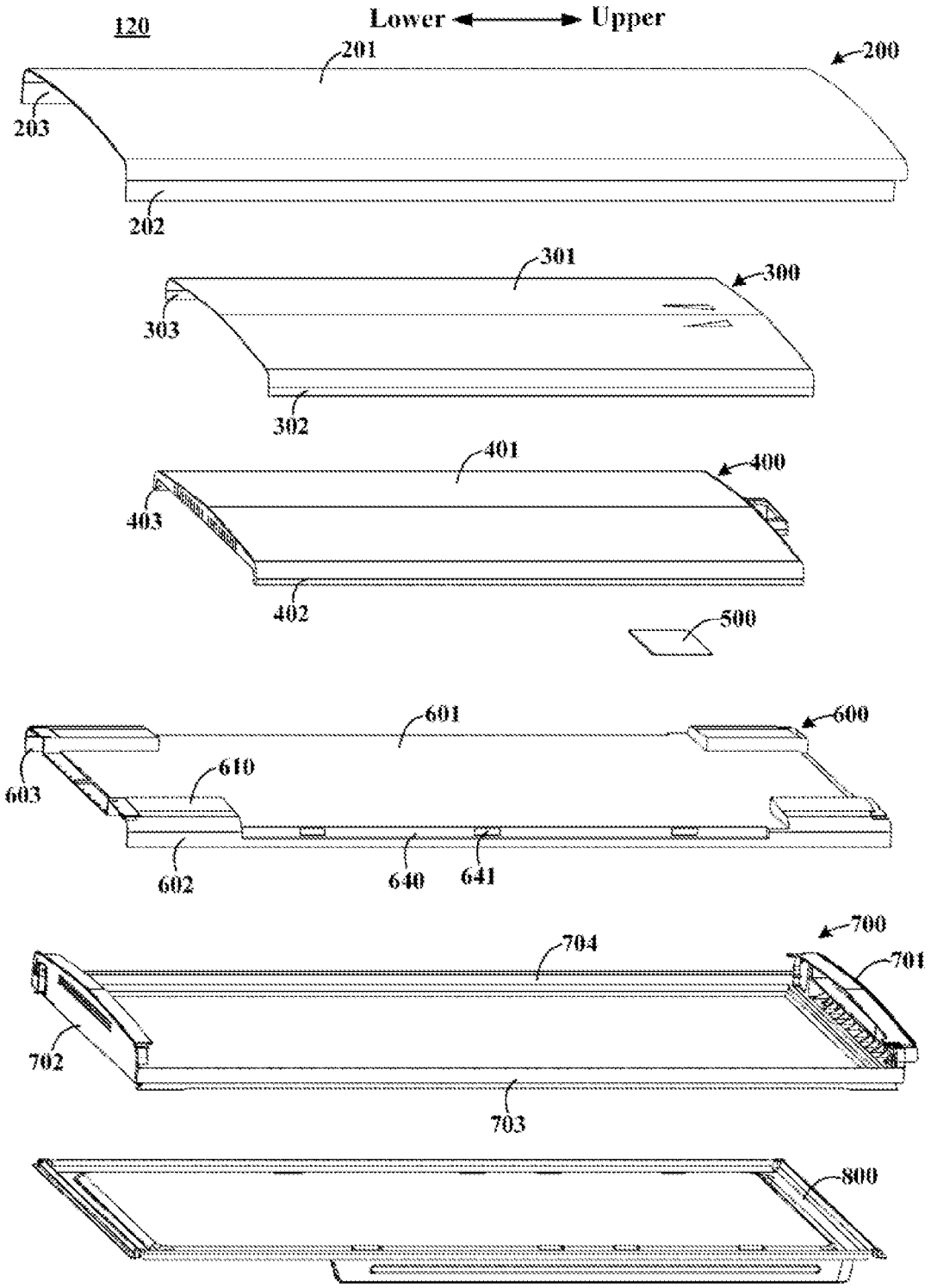
FIG. 2 is a schematic exploded view of a door of the refrigerator shown in FIG. 1.

FIG. 2 is a schematic exploded view of the door 120 of the refrigerator 100 shown in FIG. 1. The door 120 of the refrigerator 100 according to the embodiment of the present invention includes: a panel 200, a display screen 300, a main control board 500, a bracket 400, an inner door lining 600, an outer door lining 800, and a trim strip group 700. The panel 200 has a main body 201 that constitutes a front end of the door 120, a left side 202 and a right side 203. The display screen 300 is disposed behind the panel 200 and has, corresponding to the structure of the panel 200, a main body 301, a left side 302 and a right side 303. The main control board 500 is used to control the display screen 300. The bracket 400 is disposed behind the display screen 300 to provide support for the display screen 300. The inner door lining 600 is disposed behind the bracket 400 to provide support for the bracket 400. The outer door lining 800 is disposed behind the inner door lining 600 to constitute a rear end of the door 120. The trim strip group 700 includes an upper trim strip 701 constituting an upper end of the door 120, a lower trim strip 702 constituting a lower end of the door 120, a left trim strip 703, and a right trim strip 704. A foaming space is confined among the inner door lining 600, the outer door lining 800, and the trim strip group 700. The panel 200 is preferably 3D curved glass. The display screen 300 is preferably an inorganic electroluminescent (EL) display screen. The bracket 400 and the display screen 300 are fixed by gluing. The door 120 of the refrigerator 100 according to the embodiment of the present invention is provided with a panel 200 having a main body 201, a left side 202 and a right side 203, and a display screen 300 having a main body 301, a left side 302 and a right side 303, and the display screen 300 is fixed by the bracket 400 and the inner door lining 600, so as to achieve a large-screen display effect with no borders or narrow borders on the left and right sides.

Figure 3:
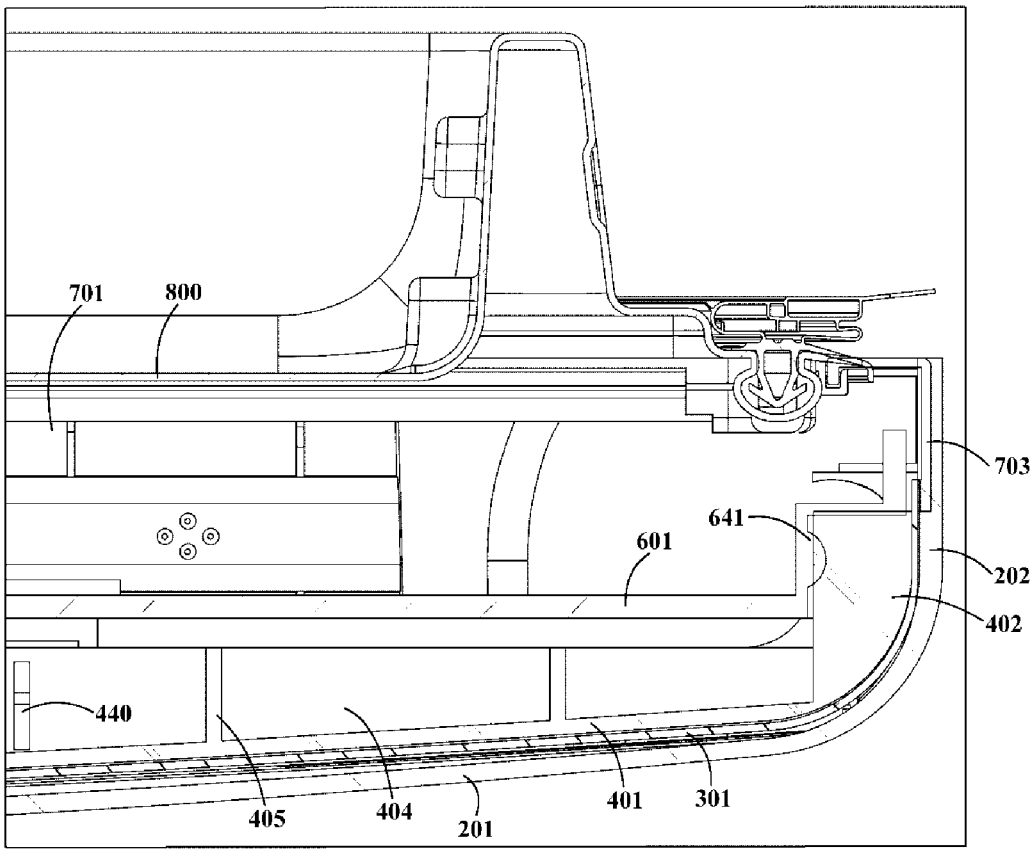
FIG. 3 is a partial schematic cross-sectional view of the door shown in FIG. 2.

FIG. 3 is a partial schematic cross-sectional view of a left part of the door 120 shown in FIG. 2 taken along the horizontal line of an auxiliary protrusion 641. In some embodiments, the left side 202 of the panel 200 of the door 120 of the refrigerator 100 according to the embodiment of the present invention constitutes a left end of the door 120, and its inner side is in contact with an outer surface of the left trim strip 703; the right side 203 of the panel 200 constitutes a right end of the door 120, and its inner surface is in contact with an outer surface of the right trim strip 704. With this structure, the door 120 of the refrigerator 100 according to the embodiment of the present invention can achieve a large-screen display effect without borders on the left and right sides.

Figure 4:
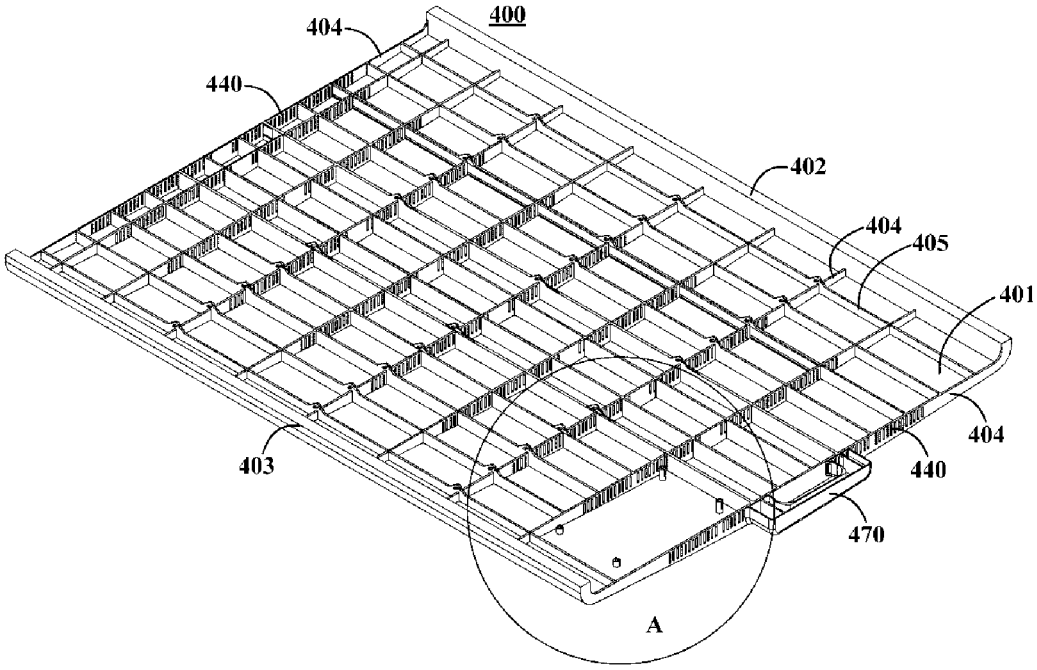
FIG. 4 is a schematic three-dimensional diagram of a bracket of the door shown in FIG. 2.
Figure 5:
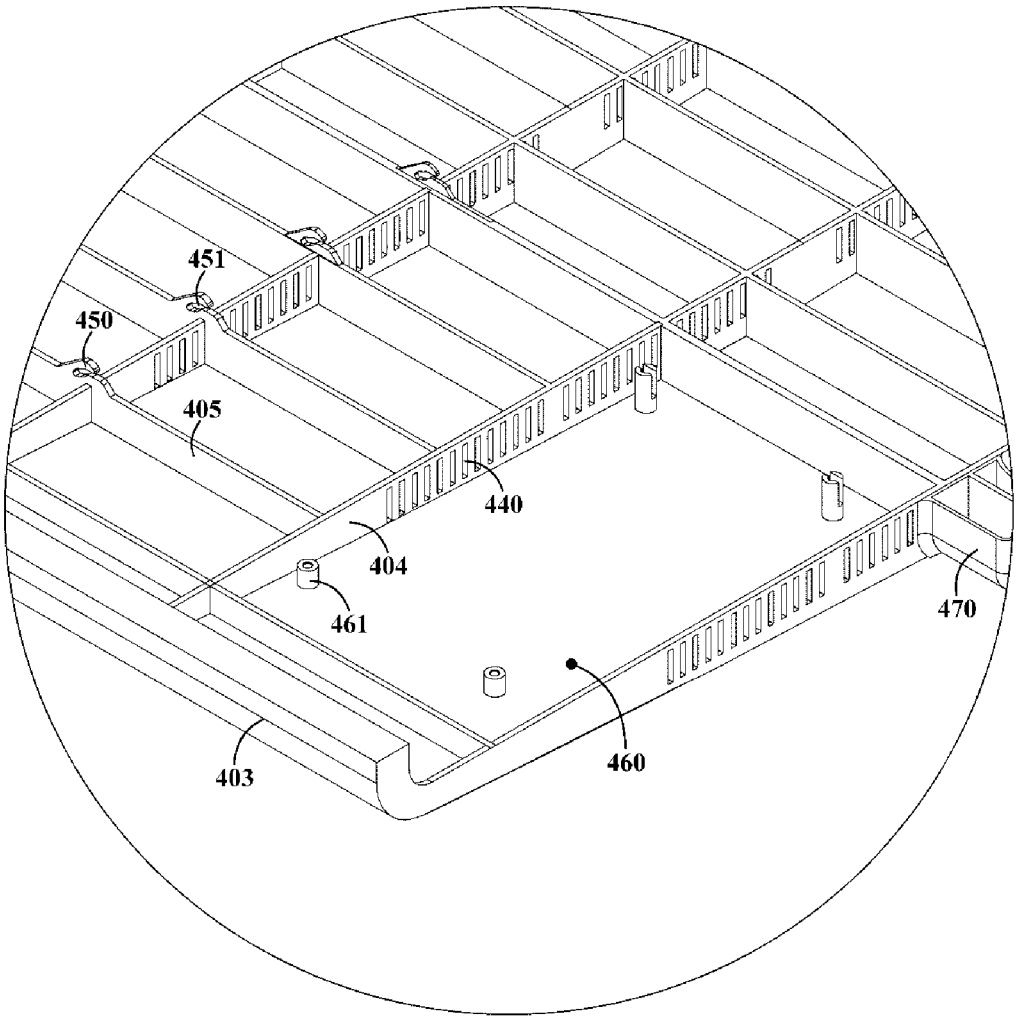
FIG. 5 is a schematic partial enlarged view of part A of the bracket shown in FIG. 4.

FIG. 4 is a schematic three-dimensional diagram of the bracket 400 of the door 120 shown in FIG. 2. FIG. 5 is a schematic partial enlarged view of part A of the bracket 400 shown in FIG. 4. In some embodiments, the bracket 400 of the door 120 of the refrigerator 100 according to the embodiment of the present invention has a main body 401, a left side 402 and a right side 403; the main body 401 of the bracket 400 is disposed corresponding to the main body 301 of the display screen 300; the left side 402 of the bracket 400 is disposed corresponding to the left side 302 of the display screen 300; and the right side 403 of the bracket 400 is disposed corresponding to the right side 303 of the display screen 300. The outer shape of the bracket 400 is the same as the inner shapes of the display screen 300 and the panel 200, and the display screen 300 can be tightly attached to the inner side of the panel 200.

In some embodiments, a plurality of support ribs are formed on an inner surface of the main body 401 of the bracket 400 of the door 120 of the refrigerator 100 according to the embodiment of the present invention. The support ribs can enhance the structural reliability of the bracket 400. Meanwhile, the support ribs and the inner door lining 600 resist against each other, which can promote the resistance between the bracket 400 and the inner door lining 600, so that the inner door lining 600 forms a forward pressure for the bracket 400, to force the display screen 300 to be in better contact with the panel 200.

Figure 6:
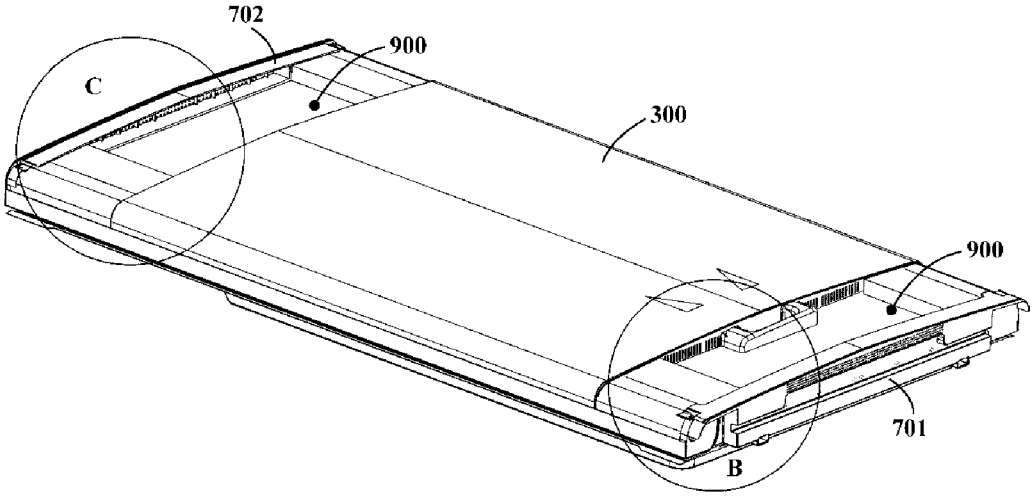
FIG. 6 is a schematic three-dimensional diagram of the door shown in FIG. 2 without a panel.
Figure 7:
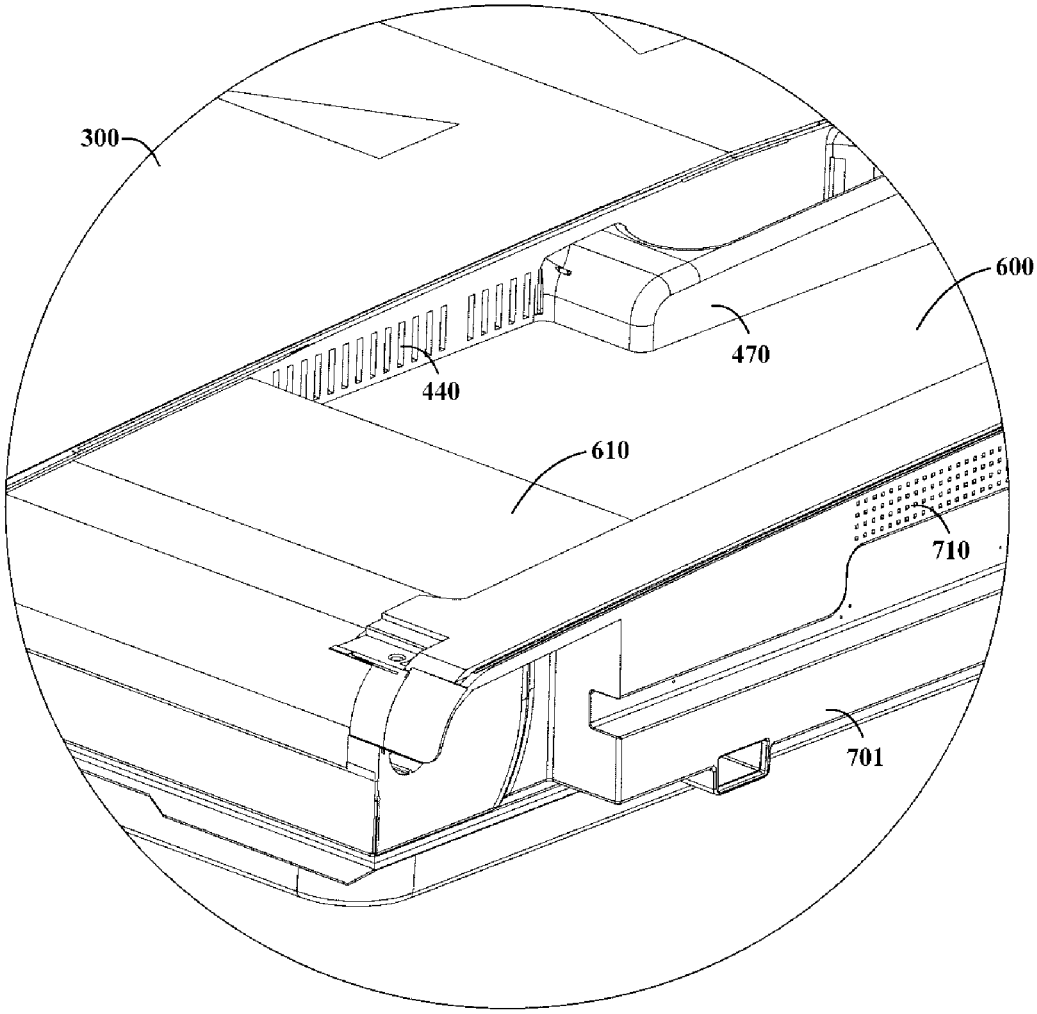
FIG. 7 is a schematic partial enlarged view of part B of the door shown in FIG. 6.
Figure 8:
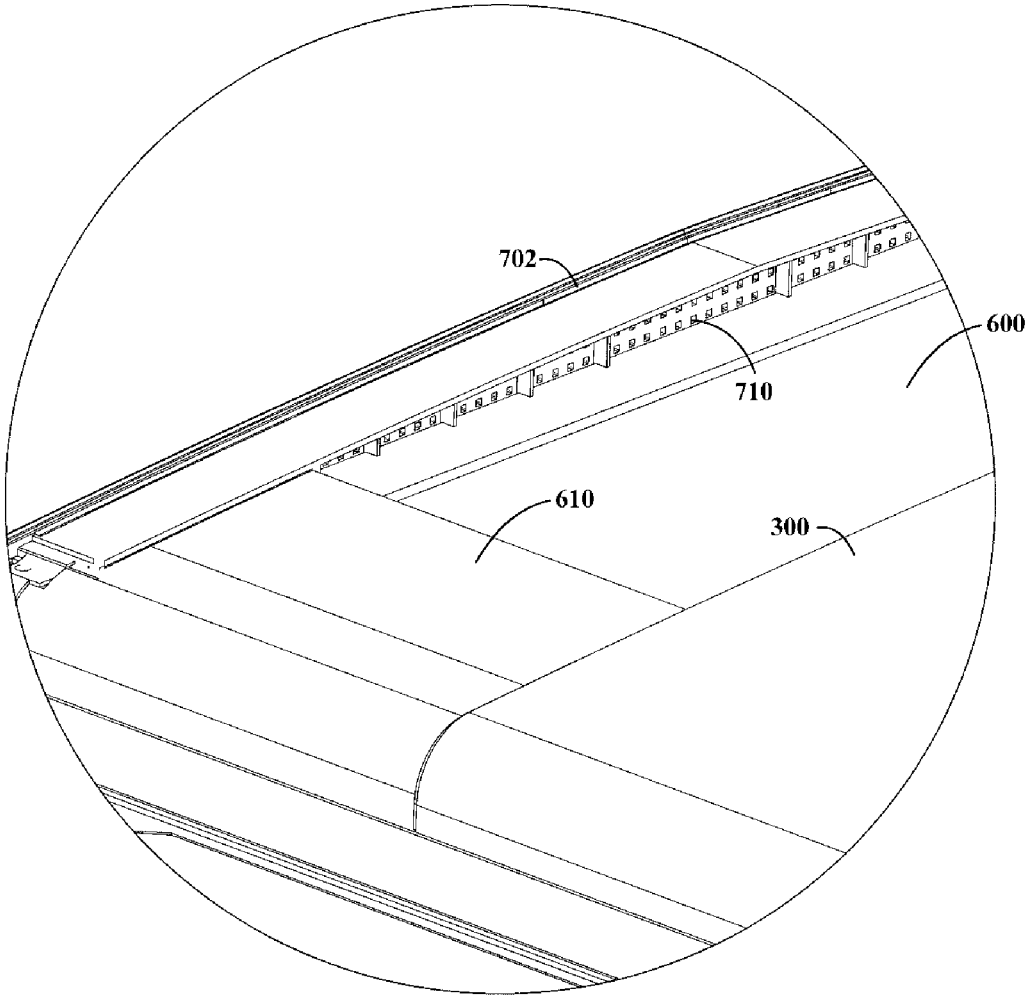
FIG. 8 is a schematic partial enlarged view of part C of the door shown in FIG. 6.

FIG. 6 is a schematic three-dimensional diagram of the door 120 shown in FIG. 2 without the panel 200. FIG. 7 is a schematic partial enlarged view of part B of the door 120 shown in FIG. 6. FIG. 8 is a schematic partial enlarged view of part C of the door 120 shown in FIG. 6. In some embodiments, the support ribs of the bracket 400 of the door 120 of the refrigerator 100 according to the embodiment of the present invention include horizontal support ribs 404 and vertical support ribs 405, and the horizontal support ribs 404 are provided with a plurality of ventilation openings 440. The upper trim strip 701 and/or the lower trim strip 702 are provided with a plurality of ventilation holes 710, and the ventilation openings 440 and the ventilation holes 710 realize heat dissipation of the display screen 300. Preferably, both the upper trim strip 701 and the lower trim strip 702 are provided with a plurality of ventilation holes 710. A lot of heat is released when the display screen 300 is working. The upper trim strip 701 and the lower trim strip 702 are provided with the ventilation holes 710, and the horizontal support ribs 404 are provided with the ventilation openings 440, so that the heat of the display screen 300 can be dissipated out of the door 120. More preferably, the left side 402 and the right side 403 of the bracket 400 are also provided with ventilation openings 440 (not shown in the figures) to enhance the heat dissipation effect.

In some embodiments, special-shaped protrusions 450 are formed at intervals on the plurality of vertical support ribs 405 of the bracket 400 of the door 120 of the refrigerator 100 according to the embodiment of the present invention; gaps 451 are formed between the special-shaped protrusions 450 and the vertical support ribs 405, and tops of the special-shaped protrusions resist against the inner door lining 600. The special-shaped protrusions 450 with gaps 451 disposed on the vertical support ribs 405 can enhance the contact between the inner door lining 600 and the bracket 400, and the gaps 451 can avoid excessive force between the inner door lining 600 and the bracket 400.

In some embodiments, a board installation area 460 for installing the main control board 500 is formed on the inner surface of the main body 401 of the bracket 400 of the door 120 of the refrigerator 100 according to the embodiment of the present invention. A board support 461 is disposed in the board installation area 460 to support and fix the main control board 500. A wire outlet is formed on the horizontal support ribs 404 corresponding to the board installation area 460.

In some embodiments, the bracket 400 of the door 120 of the refrigerator 100 according to the embodiment of the present invention further has a handle 470 to facilitate the assembly of the bracket 400 with the inner door lining 600.

In some embodiments, the inner door lining 600 of the door 120 of the refrigerator 100 according to the embodiment of the present invention has a main body 601, a left side 602 and a right side 603. Four corners of the main body 601 protrude upward respectively to form limiting portions 610, and the left side 602 and the right side 603 are recessed inward respectively to form recessed structures 640. The main body 401 of the bracket 400 is located in a space confined by the four limiting portions 610; the left side 402 of the bracket 400 is disposed corresponding to the recessed structure 640 of the left side 602 of the inner door lining 600; the right side 403 of the bracket 400 is disposed corresponding to the recessed structure 640 of the right side 603 of the inner door lining 600, which can achieve a guiding effect when the display screen 300 is installed in the inner door lining 600. Meanwhile, since the bracket 400 is shorter than the inner door lining 600, the upper and lower ends of the bracket 400 and the upper trim strip 701 and the lower trim strip 702 confine ventilation spaces 900 respectively, which is beneficial to the heat dissipation of the display screen 300.

In some embodiments, the longitudinal section of the recessed structure 640 of the inner door lining 600 of the door 120 of the refrigerator 100 according to the embodiment of the present invention is L-shaped, the recessed structure 640 has a bottom surface and a side surface, and the side surface protrudes outward to form at least one auxiliary protrusion 641. A bottom surface of the left side 402 of the bracket 400 resists against the bottom surface of the recessed structure 640 of the left side 602 of the inner door lining 600, and an inner surface of the left side of the bracket resists against the auxiliary protrusion 641 of the recessed structure 640 of the left side 602 of the inner door lining 600; a bottom surface of the right side 403 of the bracket 400 resists against the bottom surface of the recessed structure 640 of the right side 603 of the inner door lining 600, and an inner surface of the right side of the bracket resists against the auxiliary protrusion 641 of the recessed structure 640 of the right side 603 of the inner door lining 600. The auxiliary protrusions 641 can squeeze the left side 402 and the right side 403 of the bracket 400 outward, so that the left side 302 and the right side 303 of the display screen 300 are in better contact with the left side 202 and the right side 203 of the panel 200 respectively.

Figure 9:
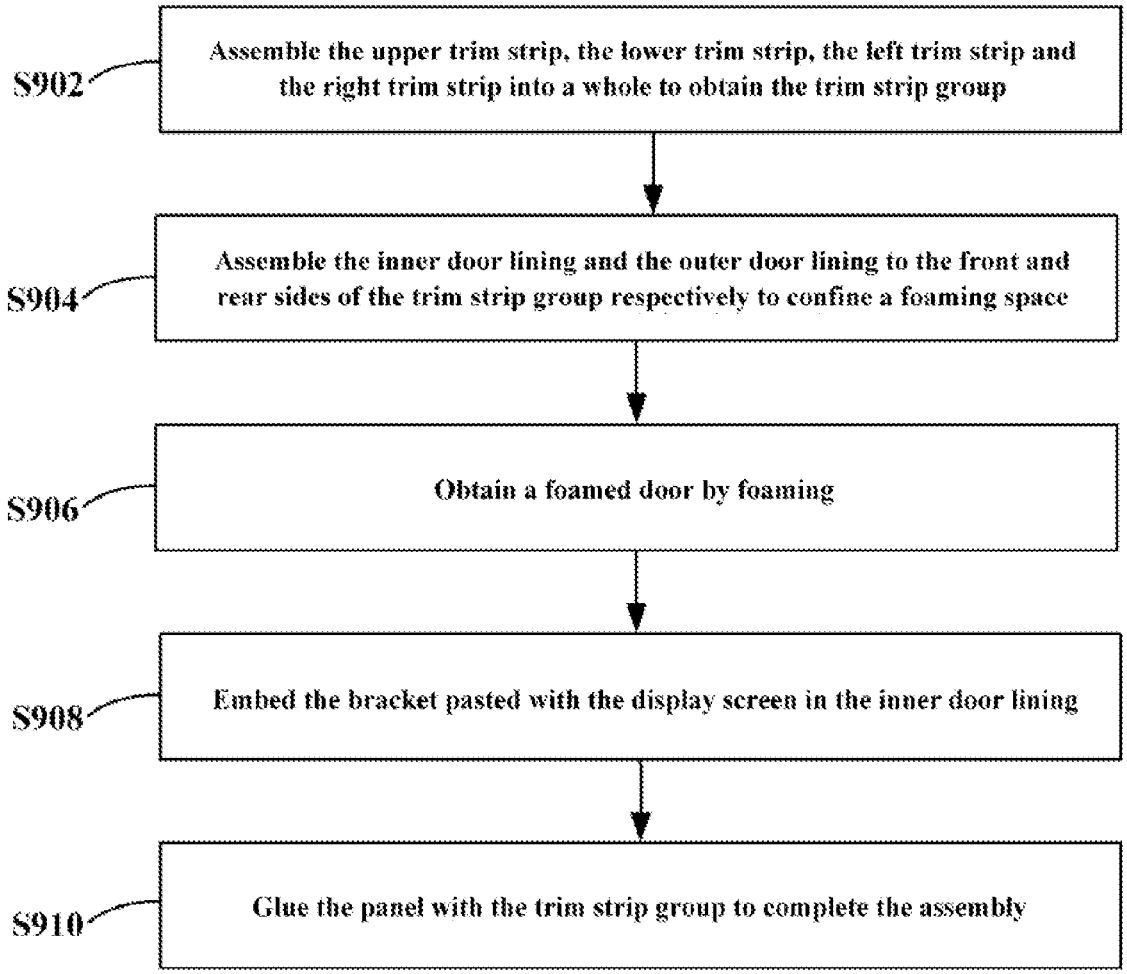
FIG. 9 is a schematic flowchart of a method for assembling the door of the refrigerator shown in FIG. 1.

FIG. 9 is a schematic flowchart of a method for assembling the door 120 of the refrigerator 100 shown in FIG. 1. The method for assembling the door 120 of the refrigerator 100 according to the embodiment of the present invention includes the following steps:

- S902: the upper trim strip 701, the lower trim strip 702, the left trim strip 703 and the right trim strip 704 are assembled into a whole to obtain the trim strip group 700;
- S904: the inner door lining 600 and the outer door lining 800 are assembled to the front and rear sides of the trim strip group 700 respectively to confine a foaming space;
- S906: a foamed door 120 is obtained by foaming;
- S908: the bracket 400 pasted with the display screen 300 is embedded in the inner door lining 600;
- S910: the panel 200 is glued with the upper trim strip 701, the lower trim strip 702, the left trim strip 703 and the right trim strip 704 respectively, to complete the assembly.

The specific assembly process of steps S902 and S904, and the specific foaming process of step S906 can adopt the existing technologies. Details are not described here.

The method for assembling the door 120 of the refrigerator 100 according to the embodiment of the present invention obtains a large-screen display door 120 of the refrigerator 100 by assembling the trim strip group 700, the inner door lining 600 and the outer door lining 800 and foaming, then assembling the bracket 400 pasted with the display screen 300, and finally gluing the panel 200, and the method also improves the overall attractiveness of the refrigerator 100 with the glass door 120.

So far, those skilled in the art should realize that although multiple exemplary embodiments of the present invention are illustrated and described in detail herein, many other variations or modifications that conform to the principle of the present invention may still be directly determined or derived from the disclosure of the present invention without departing from the spirit and scope of the present invention. Therefore, the scope of the present invention should be understood and deemed to cover all these other variations or modifications.

What is claimed is:

1. A door of a refrigerator, comprising:

a panel having a main body that constitutes a front end of the door, a left side and a right side;

a display screen disposed behind the panel and having, corresponding to the structure of the panel, a main body, a left side and a right side;

a main control board for controlling the display screen;

a bracket disposed behind the display screen to provide support for the display screen;

an inner door lining disposed behind the bracket to provide support for the bracket;

an outer door lining disposed behind the inner door lining to constitute a rear end of the door; and a trim strip group, with a foaming space being confined among the inner door lining, the outer door lining and the trim strip group, wherein the bracket has a main body, wherein a plurality of support ribs are formed on the inner side of the main body of the bracket, wherein the support ribs comprise horizontal support ribs and vertical support ribs, and the horizontal support ribs are provided with a plurality of ventilation openings, and wherein the trim strip group comprises an upper trim strip constituting an upper end of the door and a lower trim strip constituting a lower end of the door, the upper trim strip and/or the lower trim strip is provided with a plurality of ventilation holes, and the plurality of ventilation openings and the plurality of ventilation holes realize heat dissipation of the display screen.

2. The door of a refrigerator according to claim 1, wherein the trim strip group comprises a left trim strip and a right trim strip;

the left side of the panel constitutes a left end of the door, and its inner side is in contact with an outer surface of the left trim strip; and the right side of the panel constitutes a right end of the door, and its inner side is in contact with an outer surface of the right trim strip.

3. The door of a refrigerator according to claim 1, wherein the bracket also has a left side and a right side;

the main body of the bracket is disposed corresponding to the main body of the display screen;

the left side of the bracket is disposed corresponding to the left side of the display screen; and the right side of the bracket is disposed corresponding to the right side of the display screen.

4. The door of a refrigerator according to claim 3, wherein a board installation area is formed on an inner side of the main body of the bracket for installing the main control board.

5. The door of a refrigerator according to claim 1, wherein special-shaped protrusions are formed at intervals on the plurality of vertical support ribs; and gaps are formed between the special-shaped protrusions and the vertical support ribs, and tops of the special-shaped protrusions resist against the inner door lining.

6. The door of a refrigerator according to claim 3, wherein the inner door lining has a main body, a left side and a right side, the main body protrudes upward to form a plurality of limiting portions, and the left side and the right side are recessed inward respectively to form recessed structures; wherein the main body of the bracket is located in a space confined by the plurality of limiting portions;

the left side of the bracket is disposed corresponding to the recessed structure of the left side of the inner door lining; and the right side of the bracket is disposed corresponding to the recessed structure of the right side of the inner door lining.

7. The door of a refrigerator according to claim 6, wherein the longitudinal section of the recessed structure of the inner door lining is L-shaped, the recessed structure has a bottom surface and a side surface, and the side surface protrudes outward to form at least one auxiliary protrusion; wherein a bottom surface of the left side of the bracket resists against the bottom surface of the recessed structure of the left side of the inner door lining, and an inner surface of the left side of the bracket resists against the auxiliary protrusion of the recessed structure of the left side of the inner door lining; and a bottom surface of the right side of the bracket resists against the bottom surface of the recessed structure of the right side of the inner door lining, and an inner surface of the right side of the bracket resists against the auxiliary protrusion of the recessed structure of the right side of the inner door lining.

8. A method for assembling the door of a refrigerator according to claim 1, comprising the steps of:

assembling the trim strip group, the inner door lining and the outer door lining, and foaming;

assembling the bracket pasted with the display screen to the inner door lining; and gluing the panel with the trim strip group to complete the assembly of the door.

* * * * *